US011629592B1

(12) United States Patent
Paramhans et al.

(10) Patent No.: US 11,629,592 B1
(45) Date of Patent: Apr. 18, 2023

(54) EXTENDABLE DOWNHOLE TOOL AND RELATED SYSTEMS, APPARATUS, AND METHODS

(71) Applicant: Baker Hughes Oilfield Operations LLC, Houston, TX (US)

(72) Inventors: Shiva Paramhans, Houston, TX (US); David Hejl, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/500,515

(22) Filed: Oct. 13, 2021

(51) Int. Cl.
*E21B 49/02* (2006.01)
*E21B 37/02* (2006.01)

(52) U.S. Cl.
CPC ..... *E21B 49/02* (2013.01); *E21B 37/02* (2013.01)

(58) Field of Classification Search
CPC ..... E21B 49/10
See application file for complete search history.

(56) References Cited

U.S. PATENT DOCUMENTS 5,377,755 A * 1/1995 Michaels ..... E21B 49/10 166/264
7,841,402 B2 11/2010 Georgi et al.
9,051,822 B2 * 6/2015 Ayan ..... E21B 43/16
9,371,730 B2 * 6/2016 Corre ..... E21B 33/124
10,215,022 B2 * 2/2019 Tao ..... E21B 49/08
11,359,489 B2 * 6/2022 House, Jr. ..... E21B 49/10
11,421,530 B2 * 8/2022 Torgerson ..... E21B 49/08
2004/0216874 A1 * 11/2004 Grant ..... E21B 49/082 166/264
2005/0257629 A1 * 11/2005 Gilbert ..... G01N 1/10 73/863.84
2011/0094733 A1 * 4/2011 Proett ..... E21B 49/10 166/250.07
2012/0111632 A1 * 5/2012 Sherrill ..... E21B 49/10 175/50
2012/0160514 A1 * 6/2012 Evans, II ..... E21B 49/10 166/325
2014/0174169 A1 * 6/2014 Hejl ..... E21B 49/10 73/152.24
2015/0027216 A1 * 1/2015 Zhang ..... E21B 49/005 73/152.04
2015/0053399 A1 * 2/2015 Irani ..... E21B 49/081 166/305.1
2016/0237817 A1 * 8/2016 Paramhans ..... E21B 49/10

* cited by examiner

*Primary Examiner* — Shane Bomar
(74) *Attorney, Agent, or Firm* — TraskBritt

(57) ABSTRACT

An extendable downhole tool including a first extendable probe, a second extendable probe and a pressure system configured to apply pressure to the first extendable probe and the second extendable probe. The pressure system also include an extension valve configured to pass fluid pressure to an inner surface of a first piston and a second piston and a retracting valve configured to pass the fluid pressure to an outer surface of the first piston and the second piston. An area ratio of the first piston may be greater than an area ratio of the second piston. The extendable downhole tool may also include a screen and a screen scraper associated with one or more of the first extendable probe and the second extendable probe.

20 Claims, 9 Drawing Sheets

EXTENDABLE DOWNHOLE TOOL AND RELATED SYSTEMS, APPARATUS, AND METHODS

TECHNICAL FIELD

Embodiments of the present disclosure generally relate to downhole or earth-boring operations, including without limitation formation sampling. In particular, embodiments of the present disclosure relate to extendable downhole tools and related systems, apparatus, and methods.

BACKGROUND

Wellbore drilling operations may include extendable tools, such as sampling tools, reamers, etc. The extendable tools may be configured to extend arms of the extendable tools from the downhole assembly to walls of the borehole. For example, the extendable tool may be positioned in the borehole on a drill string or wireline. The extendable tool may have a diameter that is less than a diameter of the borehole. Arms may extend from the extendable tool to contact the walls of the borehole. The extendable tool may include a pressurized system, such as a hydraulic system or pneumatic system that may use fluid pressure to extend the arms of the extendable tool.

Sampling tools may include one or more extendable arms. When the extendable arms extend from the tool, one of the arms may expose an inlet port configured to receive samples, such as fluid samples, from the borehole. The sampling tools may be configured to capture multiple distinct samples of formation fluids and other materials, such that the arms may extend and retract multiple different times at different locations in the well bore.

BRIEF SUMMARY

Some embodiments of the present disclosure include an extendable downhole tool. The extendable downhole tool including a first extendable arm and a second extendable arm. The extendable downhole tool may further include a pressure system configured to apply a force to the first extendable arm and the second extendable arm. The pressure system may include a first piston coupled to the first extendable arm. The pressure system may further include a second piston coupled to the second extendable arm. The pressure system may also include an extension valve configured to pass fluid pressure to an inner surface of the first piston and the second piston. The pressure system may further include a retracting valve configured to pass the fluid pressure to an outer surface of the first piston and the second piston. An area ratio of the first piston defined by an area of the outer surface of the first piston over an area of the inner surface of the first piston may be greater than an area ratio of the second piston defined by an area of the outer surface of the second piston over an area of the inner surface of the second piston.

Another embodiment of the present disclosure may include a downhole sampling tool. The downhole sampling tool may include at least two extendable arms. Each of the at least two extendable arms may include a port and a screen. The screen may be positioned over the port and configured to filter fluid before the fluid enters the port. The at least two extendable arms may be configured to extend from and retract into a stationary portion of the downhole sampling tool. The downhole sampling tool may further include a scraping element coupled to the stationary portion of the downhole sampling tool. The scraping element may be configured to scrape a surface of the screen when the at least two extendable arms retract into the stationary portion of the downhole sampling tool.

Another embodiment of the present disclosure may include a method of biasing an extendable downhole tool. The extendable downhole tool may include at least two extendable arms. The method may include biasing the extendable downhole tool toward a first extendable arm of the at least two extendable arms by applying a pressure to an inside surface of at least two pistons coupled to the at least two extendable arms. An area of the inside surface of a first piston of the at least two pistons may be greater than an area of the inside surface of a second piston of the at least two pistons. The first piston may be coupled to the first extendable arm and the second piston may be coupled to a second extendable arm. The method may further include biasing the extendable downhole tool toward the second extendable arm of the at least two extendable arms by applying the pressure to both the inside surface of the at least two pistons and an outer surface of the at least two pistons. An area ratio of the first piston defined by an area of the outer surface of the first piston over an area of the inner surface of the first piston may be greater than an area ratio of the second piston defined by an area of the outer surface of the second piston over an area of the inner surface of the second piston.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular downhole system or component thereof, but are merely idealized representations employed to describe illustrative embodiments. The drawings are not necessarily to scale.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As used herein, the term "fluid" may mean and include fluids of any type and composition. Fluids may take a liquid form, a gaseous form, or combinations thereof, and, in some instances, may include some solid material suspended therein. In some embodiments, fluids may convert between a liquid form and a gaseous form during a cooling or heating process as described herein. In some embodiments, the term fluid includes gases, liquids, and/or pumpable mixtures of liquids and solids.

As used herein, the terms "behind" and "ahead" when used in reference to a component of a drill string, casing string, or wireline refer to a direction relative to the motion of the downhole component. For example, if the component is moving into a borehole a bottom of the borehole is ahead of the component and the surface and the drill rig are behind the component.

Figure 1:
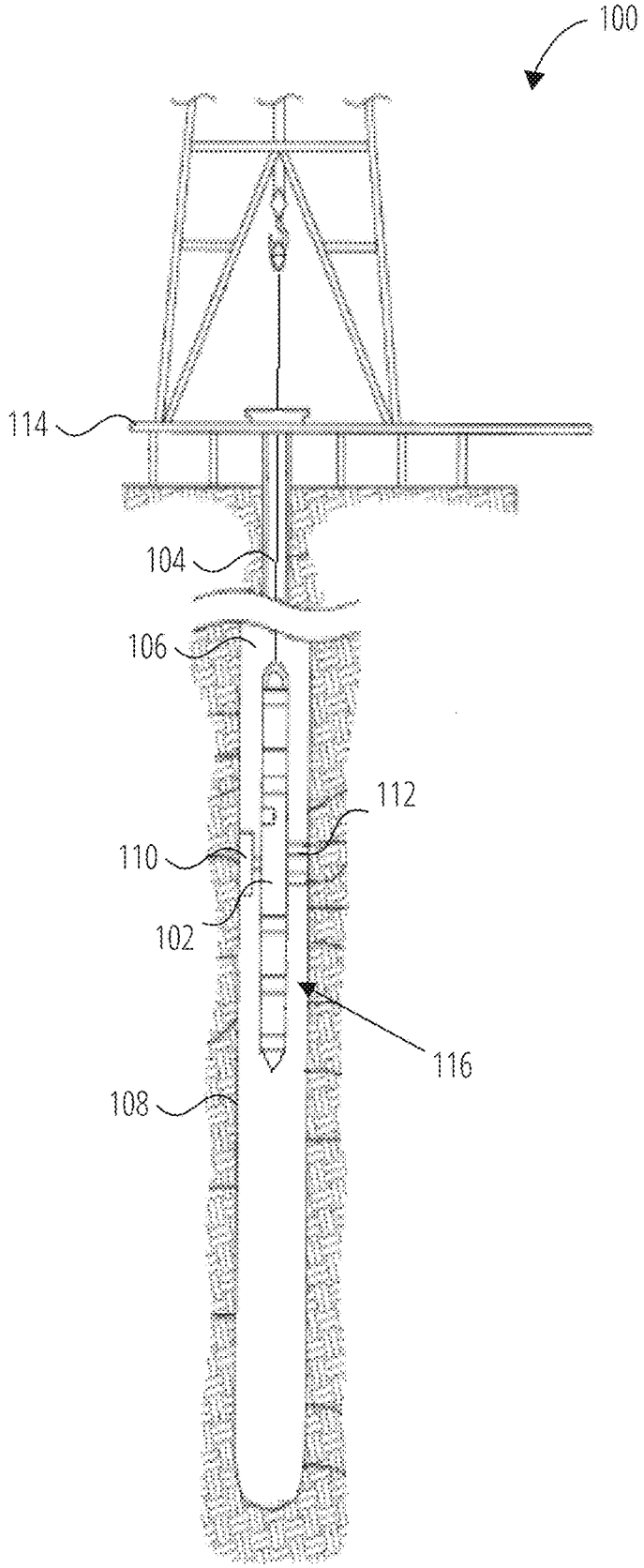
FIG. 1 illustrates a downhole system according to an embodiment of the present disclosure.

FIG. 1 illustrates a downhole system 100. The downhole system 100 may include a drilling platform 114 at the surface. The drilling platform 114 may be positioned over a bore hole 106. In some embodiments, the bore hole 106 may be a previously drilled bore hole 106. In some embodiments, a drill string may extend from the drilling platform 114 into the bore hole 106 with an earth-boring tool configured to drill the bore hole 106 extending a length of the bore hole 106 and/or a depth of the bore hole 106.

FIG. 1 illustrates a line 104 suspending a downhole tool 116 in the bore hole 106. The line 104 may be configured to drop the downhole tool 116 into the bore hole 106 after the bore hole 106 has been formed by an earth-boring tool on a drill string. The downhole tool 116 may include a sampling tool 102. The sampling tool 102 may include an extendable probe 110 that may extend radially from the sampling tool 102 to collect fluid samples from the bore hole 106. The extendable probe 110 may be extended from the sampling tool 102 until the extendable probe 110 contacts a borehole wall 108. The sampling tool 102 may also include opposing feet 112 that may extend from the sampling tool 102 such that the extendable probe 110 may reach the borehole wall 108. For example, the opposing feet 112 may extend from an opposite side of the sampling tool 102 from the extendable probe 110 such that each of the extendable probe 110 and the opposing feet 112 contact the borehole wall 108.

Each of the extendable probe 110 and the opposing feet 112 may extend from the sampling tool 102 under the control of a pressurized system, such as a hydraulic system or a pneumatic system. The pressurized system may be configured such that the extendable probe 110 extends with a greater force than the opposing feet 112 such that if each of the extendable probe 110 and the opposing feet 112 contact the borehole wall 108 before they are fully open the extendable probe 110 may overpower the opposing feet 112 and open fully leaving the opposing feet 112 only partially extended or even preventing the opposing feet 112 from extending.

The sampling tool 102 may be configured to collect multiple samples at multiple distinct locations within the bore hole 106. The sampling tool 102 may extend the extendable probe 110 and the opposing feet 112 at each of the distinct locations to collect the sample and retract the extendable probe 110 and the opposing feet 112 once each sample is collected. In some cases, a failure of a component may substantially prevent the extendable probe 110 from extending and/or collecting samples. For example, a clog in the extendable probe 110, such as a plugged port may substantially prevent the extendable probe 110 from collecting samples. In some embodiments, a broken seal on one or more pistons associated with the pressurized system may substantially prevent one or more of the extendable probe 110 or the opposing feet 112 from extending. If the extendable probe 110 is prevented from opening the sampling tool 102 may be unable to collect samples. To resolve the failures of the sampling tool 102, the entire downhole tool 116 may need to be removed from the bore hole 106.

In some cases, removing the downhole tool 116 from the bore hole 106 may take a significant amount of time, such as several hours or even multiple days. In some cases, the downhole tool 116 may be coupled to a drill string that is actively drilling the bore hole 106. Thus, removing the downhole tool 116 from the bore hole 106 may involve stopping the drilling operation to trip out the drill string, which may further increase the cost of the failure to the operation.

Figure 2:
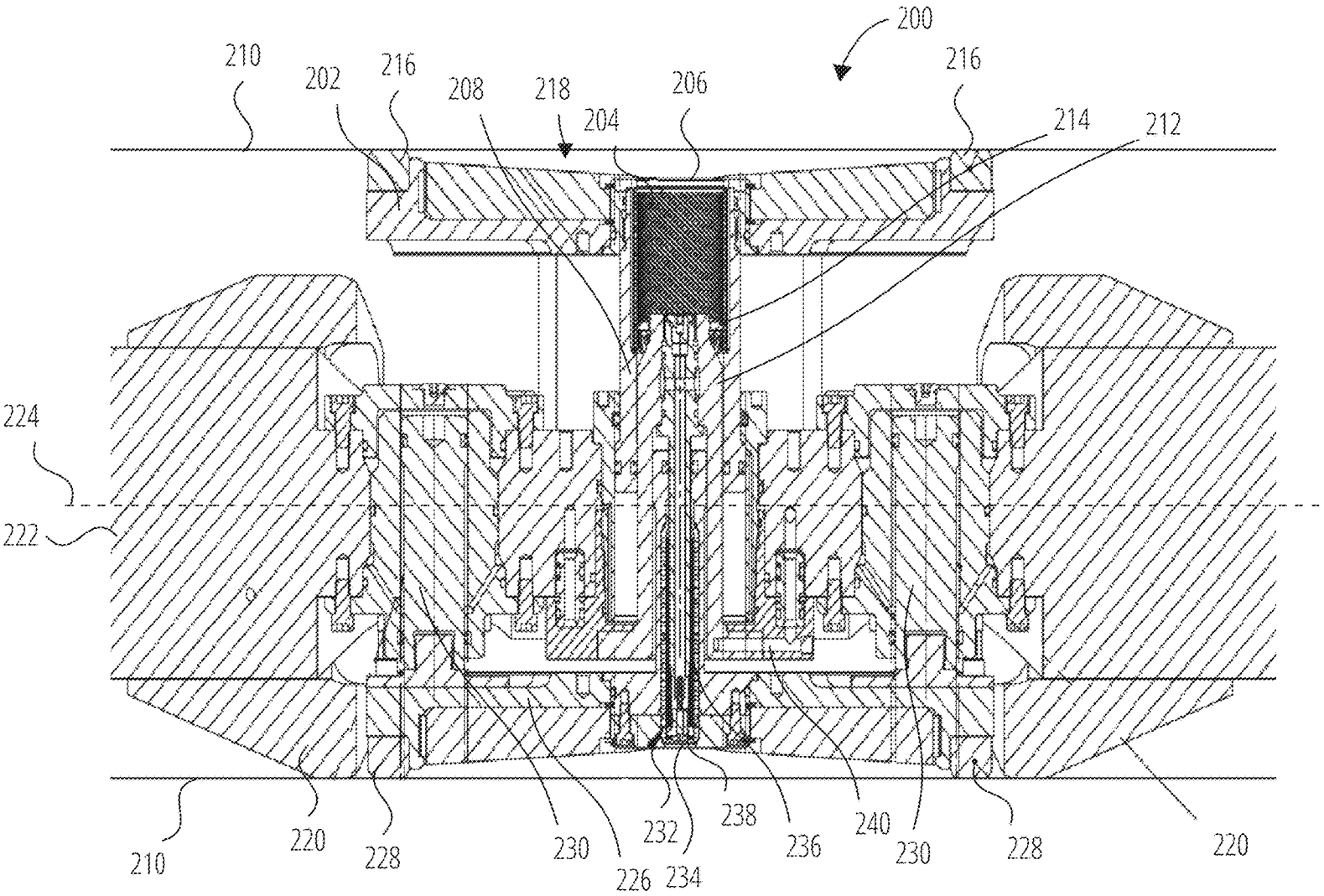
FIG. 2 illustrates a sampling tool according to an embodiment of the present disclosure.

FIG. 2 illustrates a cross-sectional view of an embodiment of a sampling tool 200. In some embodiments, the downhole tool 222 may be coupled to the surface through a wireline, as illustrated in FIG. 1. In some embodiments, the downhole tool 222 may be part of a drill string, such as part of a bottom hole assembly (BHA) or a tool located mid-string (e.g., between the BHA and the surface). In some embodiments, the drill string may be formed from sections of drill pipe threaded together to form a string. In some embodiments, the drill string may be formed from coiled tubing. In some embodiments, the sampling tool 200 may be coupled directly to the drill string or the wireline.

The sampling tool 200 may include a first probe 202 or arm configured to extend from the sampling tool 200. The first probe 202 may extend until the first probe 202 contacts a borehole wall 210. The first probe 202 may include one or more wall seals 216. The wall seal 216 may be configured to trap a sampling volume 218 between the first probe 202 and the borehole wall 210. The sampling tool 200 may then capture a sample fluid from the sampling volume 218 through a first port 206 in the first probe 202.

The first port 206 may include a first screen 204 positioned within the first port 206 (e.g., between the first port 206 and the sampling volume 218). The first screen 204 may be configured to filter the sample fluid as the sample fluid passes through the first port 206. For example, the sample fluid may include mud, rocks, and/or debris from the drilling operation and/or the formation suspended in the sample fluid. The mud, rocks, and debris may clog the first port 206 and/or internal passageways within the sampling tool 200. The first screen 204 may be configured to substantially prevent mud, rocks, or debris from passing through the first port 206 into the sampling tool 200, such that the sampling fluid may pass into the sampling tool 200 without any suspended mud, rocks, or debris.

The sampling tool 200 may include a stationary element 212. A first piston 208 may be configured to travel along the stationary element 212 in a radial direction relative to a tool axis 224 of the sampling tool 200. In some embodiments, the first piston 208 and the stationary element 212 may each be cylindrical. The first piston 208 may be substantially coaxial with the stationary element 212, such that the first piston 208 substantially surrounds the stationary element 212. The first piston 208 may be configured to slide along an outside surface of the stationary element 212. The first piston 208 may be configured to transmit a force from a pressurized fluid, such as a hydraulic fluid or a pneumatic fluid, to the first probe 202. The first piston 208 may cause the first probe 202 to extend out of the sampling tool 200 or to retract into the sampling tool 200 in the radial direction defined by the stationary element 212.

The stationary element 212 may include a first scraper 214. The first scraper 214 may be configured to clean the first screen 204 as the first probe 202 moves relative to the stationary element 212, as described in further detail with respect to FIG. 3.

The sampling tool 200 may include a second probe 226 or arm on an opposite side of the sampling tool 200 from the first probe 202. The second probe 226 may be configured to extend from the sampling tool 200. The second probe 226 may extend until the second arm 226 contacts the borehole wall 210. The second probe 226 may include one or more wall seals 228.

The second probe 226 may include a second port 234. The second port 234 may include a second screen 232 positioned within the second port 234. The second screen 232 may be configured to filter a fluid as the fluid passes through the second port 234. The second screen 232 may be configured to substantially prevent mud, rocks, or debris from passing through the second port 234 into the sampling tool 200, such that the sampling fluid may pass into the sampling tool 200 without any suspended mud, rocks, or debris.

The first port 206 and the second port 234 may be connected to a common internal passages 240 through individual passages through each of the first port 206 and the second port 234 that are each connected to the common internal passage 240 inside the mandrel line, such that fluid may pass through whichever port 206, 234 is open into the common internal passage 240. The common internal passages 240 may pass the fluid to a fluid cell (not shown) that may include sampling chambers, testing chambers, collection chambers, etc., as described in U.S. Pat. No. 7,841,402, titled METHODS AND APPARATUS FOR COLLECTING A DOWNHOLE SAMPLE, filed Apr. 9, 2008, and issued Nov. 30, 2010, the disclosure of which is incorporated herein in its entirety by this reference.

Figure 6:
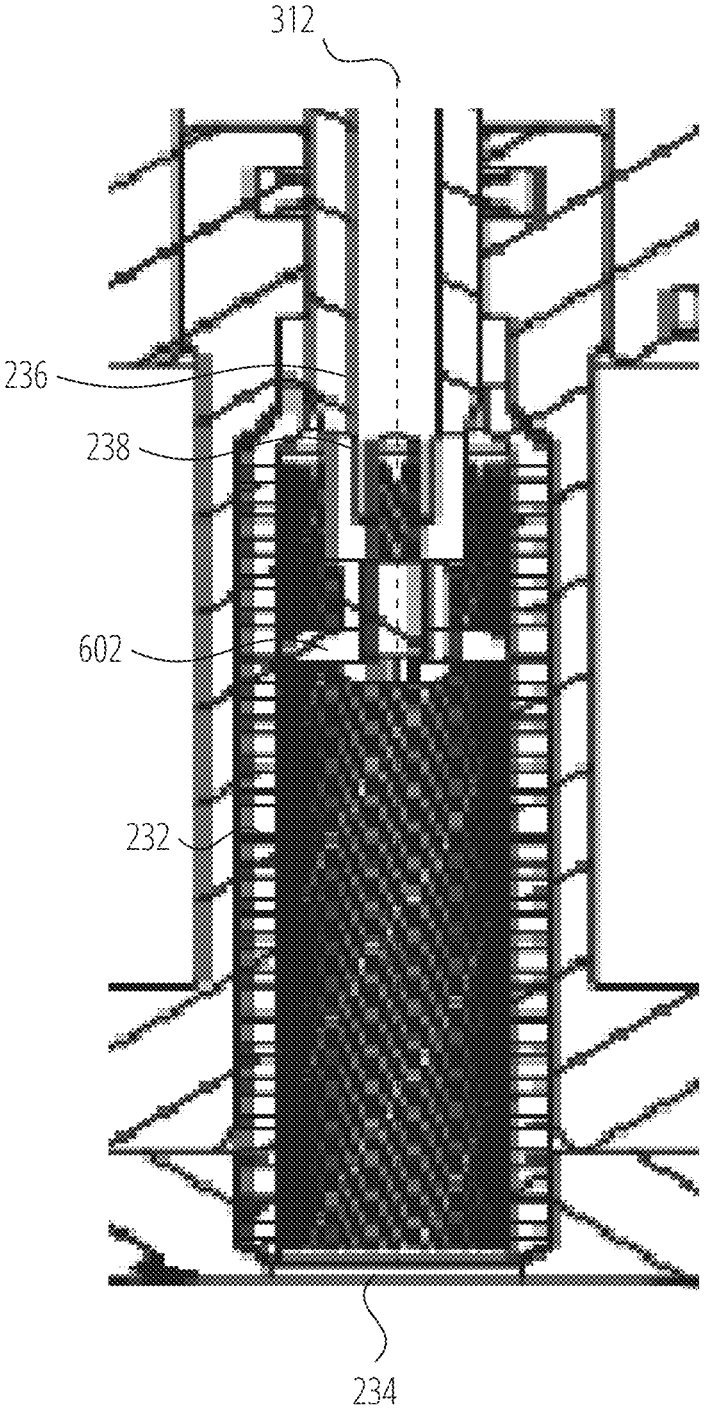
FIG. 6 illustrates an enlarged view of a portion of the embodiment of the sampling tool illustrated in FIG. 5.

The sampling tool 200 may include a stationary element 236. The stationary element 236 may include a second scraper 238. The second scraper 238 may be configured to clean the second screen 232 as the second probe 226 moves relative to the stationary element 236, as described in further detail with respect to FIG. 6. The stationary element 236 may be substantially coaxial with the stationary element 212, and the ports 206, 234.

The sampling tool 200 may include one or more second pistons 230 configured to transmit a force from a pressurized fluid, such as a hydraulic fluid or a pneumatic fluid, to the second probe 226. The second pistons 230 may cause the second probe 226 to extend out of the sampling tool 200 or to retract into the sampling tool 200 in the radial direction defined by the stationary element 236.

In some embodiments, the first probe 202 and/or the second probe 226 may be a circular or rectangular surface, such that the wall seal 216 and the wall seal 228 are substantially annular (e.g., ring shaped) seals. In some embodiments, the first probe 202 and/or the second probe 226 may be another shape, such as a square shape (e.g., cuboid), a rectangular shape, etc. In some embodiments, a surface of the first probe 202 and/or the second probe 226 facing the borehole wall 210 may have a curved shape, substantially complementary to the curved surface of the borehole wall 210. In some embodiments, the surface of the first probe 202 and/or the second probe 226 may be substantially flat.

In some embodiments, the wall seals 216, 228 may be configured to deform to form a seal between the first probe 202 and/or the second probe 226 and the borehole wall 210. For example, the wall seals 216, wall seal 228 may be formed from a resilient material. In some embodiments, the wall seals 216, 228 may be formed from a hard material configured to maintain a shape when pushed against the borehole wall 210.

The sampling tool 200 may include bumpers 220 extending over an adjacent downhole tool 222. The bumpers 220 may be configured to protect the sampling tool 200. For example, the bumpers 220 may be a tapered surface transitioning from an outer circumference of the downhole tool 222 to the outer circumference of the sampling tool 200. The outer circumference of the sampling tool 200 may be at least partially defined by the first probe 202 and/or the second probe 226 in a retracted position. The bumpers 220 may substantially prevent debris and/or borehole protrusions from contacting a leading surface and/or trailing surface of the first probe 202 and/or the second probe 226 while the sampling tool 200 is being inserted or removed from the wellbore.

Figure 3:
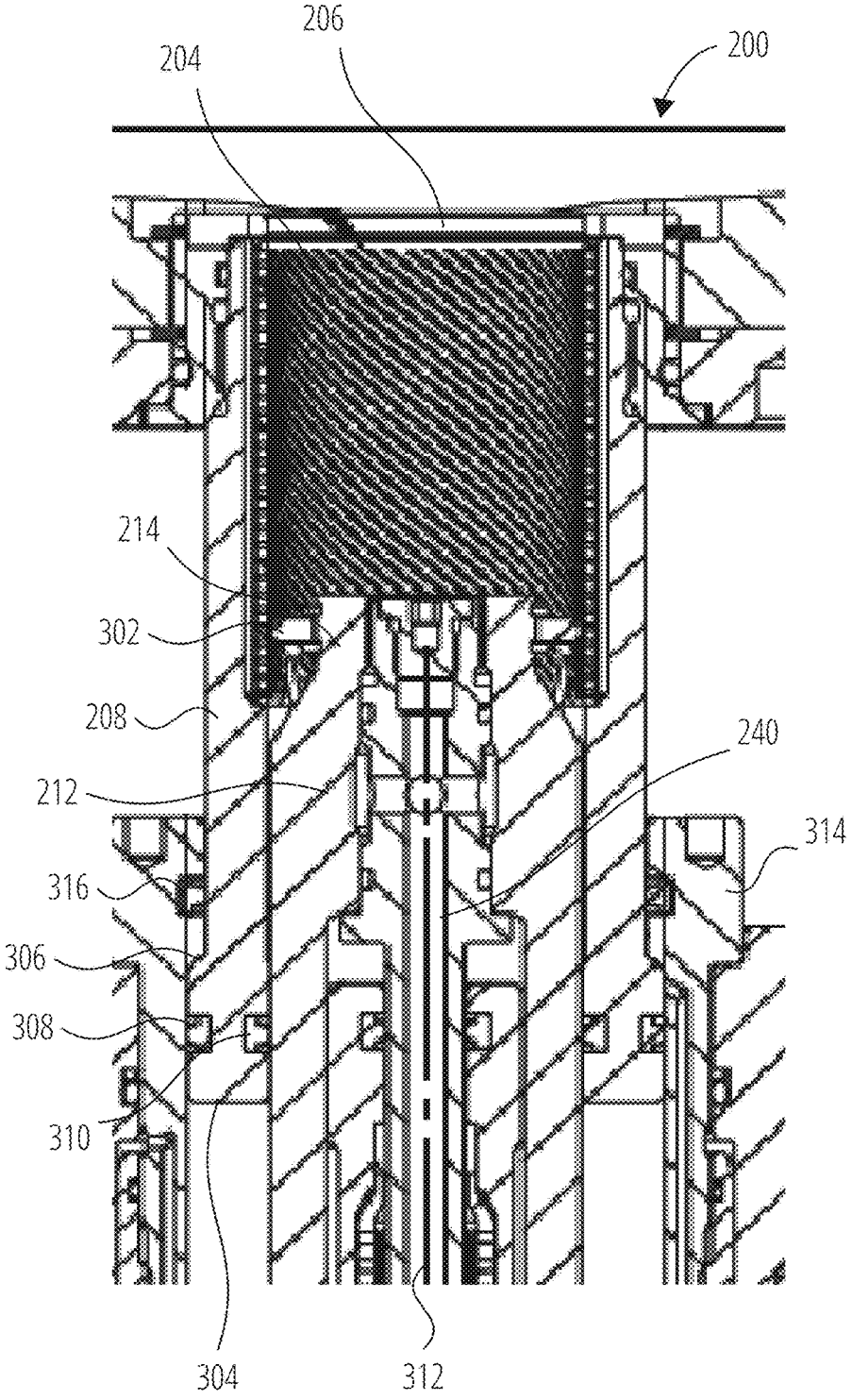
FIG. 3 illustrates an enlarged view of a portion of the embodiment of the sampling tool illustrated in FIG. 2.

FIG. 3 illustrates an enlarged view of the first piston 208 of the first probe 202 of the sampling tool 200. As illustrated in FIG. 3, the first piston 208 may be a single centrally located piston. In some embodiments, the first piston 208 may be formed from multiple first pistons 208 arranged in a manner similar to the second pistons 230 associated with the second arm probe. For example, the first piston 208 may be formed from two first pistons 208, four first pistons 208, etc.

The first piston 208 may include an extending pressure surface 304 and a retracting pressure surface 306. The extending pressure surface 304 and the retracting pressure surface 306 may be separated by an outer seal 308 and 316 and an inner seal 310. A pressurized system may selectively transfer pressure to the extending pressure surface 304 and/or the retracting pressure surface 306 through a pressurized fluid, such as a hydraulic fluid (e.g., a liquid, such as oil) or a pneumatic fluid (e.g., a gas such as air, nitrogen, etc.). The pressurized fluid may act on the extending pressure surface 304 of the first piston 208 to generate a force in a direction away from the sampling tool 200. The pressurized fluid may act on the retracting pressure surface 306 to generate a force in a direction toward the sampling tool 200. Thus, by selectively transferring pressure to the extending pressure surface 304 through the pressurized fluid the pressurized system may cause the first piston 208 and the associated first probe 202 to extend away from the sampling tool 200. In another instance, the pressurized system may selectively transfer pressure to the retracting pressure surface 306 through the pressurized fluid causing the first piston 208 and the associated first probe 202 to retract into the sampling tool 200.

The force exhibited on the first piston 208 may be proportional to the area of the extending pressure surface 304 and/or the retracting pressure surface 306 on which the pressurized fluid is acting. The area of the extending pressure surface 304 may be greater than the area of the retracting pressure surface 306. The greater area of the extending pressure surface 304 may enable the same amount of pressure in the pressurized fluid to extend the first probe 202 with more force than the pressurized fluid generates to retract the first probe 202. In some instances, the pressurized system may selectively transfer pressure to both of the extending pressure surface 304 and the retracting pressure surface 306 through the pressurized fluid. Because the area of the extending pressure surface 304 is greater than the area of the retracting pressure surface 306 the net force on the first piston 208 may be in a direction away from the sampling tool 200. However, the force toward the sampling tool 200 resulting from the pressurized fluid acting on the retracting pressure surface 306 may detract from the outward force resulting from the pressurized fluid acting on the extending pressure surface 304 resulting in a reduced net outward force.

The first piston 208 may be configured to translate along the stationary element 212 and 314. For example, the first piston 208 may be substantially coaxial with the stationary element 212 and 314. The stationary element 314 may be configured to substantially prevent movement of the first piston 208 in a radial direction relative to an expansion axis 312, while allowing the first piston 208 to move axially along the expansion axis 312. The expansion axis 312 may extend in a radial direction relative to the tool axis 224 discussed above.

The stationary element 212 may include a first scraper 214. The first scraper 214 may include a blade 302 extending radially from the first scraper 214. The blade 302 may be configured to scrape a surface of the first screen 204 as the first screen 204 moves relative to the first scraper 214. For example, the first scraper 214 and associated blade 302 may be coupled to the stationary element 212, such that the first scraper 214 and the blade 302 remain substantially stationary relative to the sampling tool 200. The first screen 204 may be coupled to the first piston 208, such that the first screen 204 may move axially relative to the stationary element 212 and the first scraper 214. Thus, as the first screen 204 moves relative to the stationary element 212 and the first scraper 214, the blade 302 may be in sliding contact with a surface of the first screen 204, such that any debris, rocks, or mud attached to the first screen 204 may be removed by the blade 302 each time the first piston 208 moves the first probe 202 relative to the stationary element 212.

In some embodiments, the blade 302 may be a substantially continuous element, such as an annular ring. In some embodiments, the blade 302 may be formed from multiple closely spaced elements, such as fingers, or bristles. In some embodiments, the blade 302 may be formed from a rigid material, such that the material may not deform as the first screen 204 moves along the blade 302. In some embodiments, the blade 302 may be formed from a resilient material, such as a polymer material, a rubber material, a thin metallic material, etc.

Figure 4:
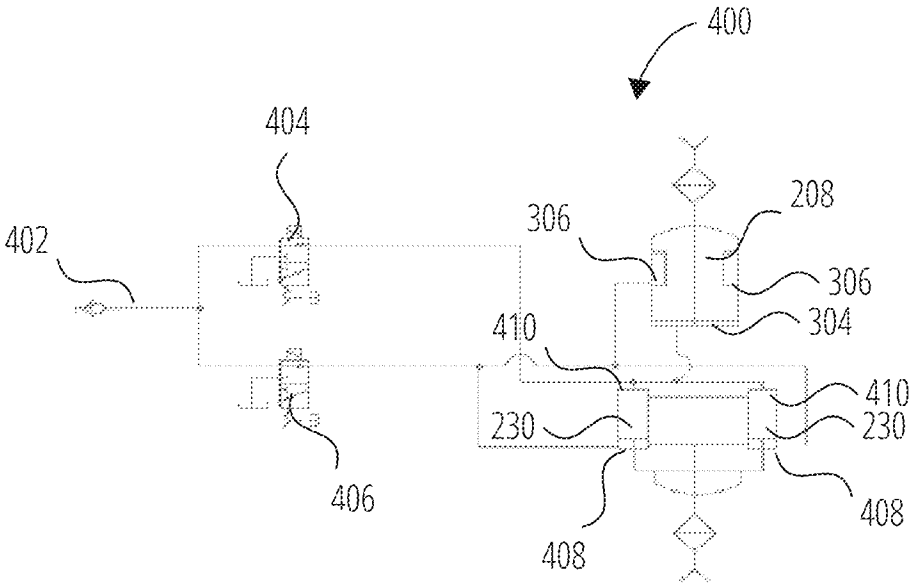
FIG. 4 is a schematic illustration of a pressurized system according to an embodiment of the present disclosure.

FIG. 4 illustrates a schematic of the pressurized system 400 with the active lines shown for the sampling tool 200 to be in the position shown in FIG. 2. The pressurized system 400 may include a pressurized fluid 402. As discussed above, the pressurized fluid 402 may be a pressurized liquid, such as a hydraulic fluid (e.g., oil) or a pressurized gas, such as in a pneumatic system. In some embodiments, the pressurized system 400 may include a compressor or pump (not shown) configured to pressurize the pressurized fluid 402.

Figure 9:
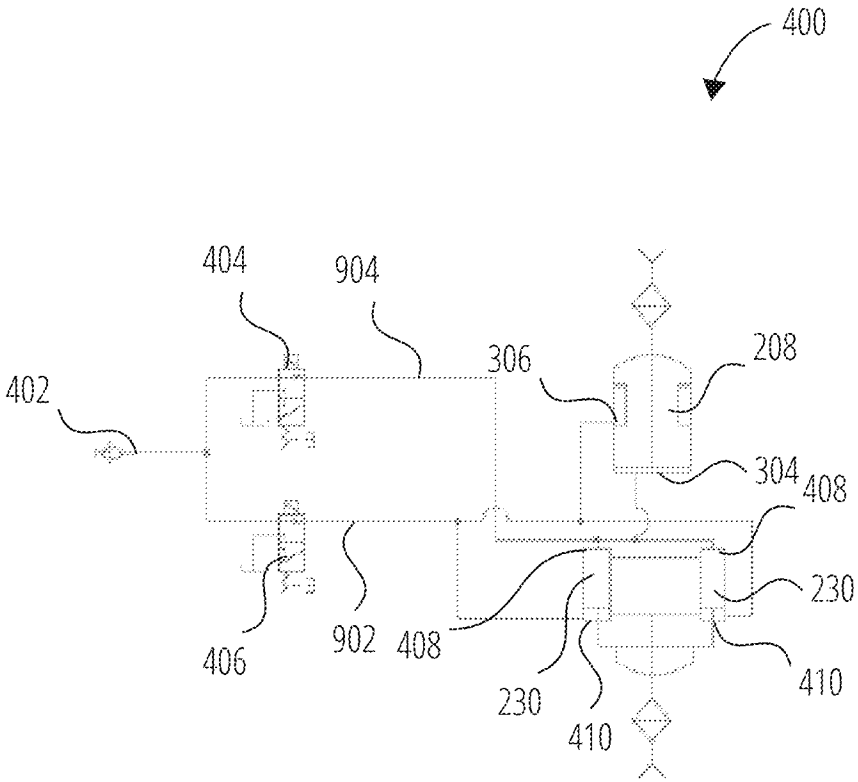
FIG. 9 is a schematic illustration of a pressurized system according to an embodiment of the present disclosure.

The pressurized system 400 may include an extending valve 404 and a retracting valve 406 configured to control flow of the pressurized fluid 402 to the pistons 208, 230. For example, as shown in FIG. 4, the extending valve 404 may selectively allow flow of the pressurized fluid 402 to the extending pressure surface 304 of the first piston 208 and an extending pressure surface 410 of the second pistons 230. Similarly, as illustrated in FIG. 9, the retracting valve 406 may selectively allow flow of the pressurized fluid 402 to the retracting pressure surface 306 of the first piston 208 and a retracting pressure surface 408 of the second piston 230.

The area of the extending pressure surface 304 of the first piston 208 may be greater than the combined area of the extending pressure surfaces 410 of the second pistons 230. Thus, the pressurized fluid 402 flowing to the extending pressure surface 304 of the first piston 208 and the extending pressure surfaces 410 of the second piston 230 may generate a greater amount of force against the first piston 208 than the combined force against the second pistons 230. The greater force may cause the first piston 208 to extend pushing the first probe 202 coupled to the first piston 208 away from the sampling tool 200. The lower force acting on the second pistons 230 may cause the second probe 226 to only extend if the first probe 202 stops traveling before reaching the borehole wall 210, thereby ensuring that the first piston 208 is fully extended before the second probe 226 extends.

In some embodiments, the combined area of the extending pressure surface 410 of the second piston 230 may be greater than the area of the extending pressure surface 304 of the first piston 208. Thus, the greater force may be applied to the second pistons 230 instead of the first piston 208. In such an embodiment, the second probe 226 may extend fully to open the second port 234 before the first probe 202 begins to open. The difference in areas of the extending pressure surface 304 and the extending pressure surfaces 410 may create a bias in the pressurized system 400. The bias may enable the designers to select which of the first probe 202 and second probe 226 opens eventually through the design of the first pistons 208 and the second pistons 230.

In some embodiments, the areas of the extending pressure surface 304, retracting pressure surface 306, extending pressure surfaces 410, and retracting pressure surfaces 408 may be configured such that the bias between the first probe 202 and the second probe 226 may be controlled by different pressure conditions created by the pressurized system 400. Such design considerations and control conditions are further described below with respect to FIGS. 8 and 9.

Figure 5:
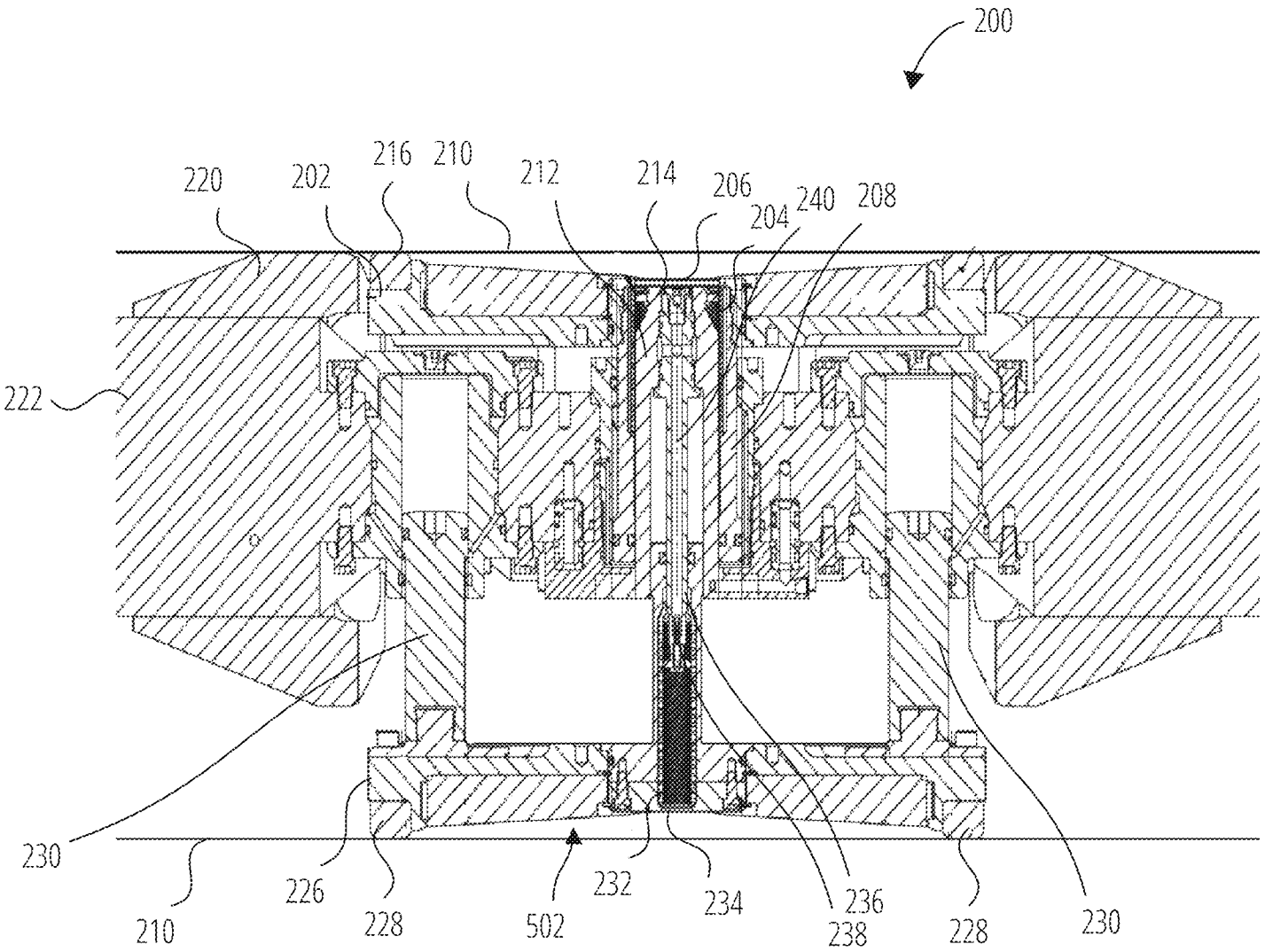
FIG. 5 illustrates the sampling tool according to the embodiment illustrated in FIG. 2 in a different position.

FIG. 5 illustrates the sampling tool 200 with the force biased toward the second probe 226. The second probe 226 may be configured to extend from the sampling tool 200. The second probe 226 may extend until the second probe 226 contacts the borehole wall 210. The second probe 226 may include one or more wall seals 228. The wall seals 228 may be configured to trap a second sampling volume 502. Once the second probe 226 is open, fluid within the second sampling volume 502 may flow into the second port 234.

The second port 234 may include a second screen 232. The second screen 232 may be configured to filter the fluid as the fluid passes through the second port 234. The second screen 232 may be configured to substantially prevent mud, rocks, or debris from passing through the second port 234 into the sampling tool 200, such that the sampling fluid may pass into the sampling tool 200 without any suspended mud, rocks, or debris.

The sampling tool 200 may include a stationary element 236. The stationary element 236 may include a second scraper 238. The second scraper 238 may be configured to clean the second screen 232 as the second probe 226 moves relative to the stationary element 236, as described in further detail with respect to FIG. 6. The stationary element 236 may be substantially coaxial with the common internal passage 240, the stationary element 212, and the ports 206, 234.

The sampling tool 200 may include one or more second pistons 230 configured to transmit a force from a pressurized fluid, such as a hydraulic fluid or a pneumatic fluid, to the second probe 226. The second pistons 230 may cause the second probe 226 to extend out of the sampling tool 200 or to retract into the sampling tool 200 in the radial direction defined by the stationary element 236. In some embodiments, the second pistons 230 may be positioned on opposite ends of the second probe 226. The second pistons 230 may extend from separate chambers under a common pressure. In some embodiments, the second pistons 230 may be substantially the same size, such that a resulting force on the second probe from each of the second pistons 230 is substantially the same. In some embodiments, the sizes of the second pistons 230 may be different such that the resulting force is biased to one end or the other of the second probe 226. The net force on the second probe 226 may be the sum of the resulting forces of all of the second pistons 230.

As illustrated in FIG. 5, when the second probe 226 extends the second port 234 may be opened such that fluid may flow into the second port 234 through the second screen 232. The first probe 202 may remain substantially retracted.

In some embodiments, the sampling tool 200 may be configured to selectively bias the sampling tool 200 between the first probe 202 and the second probe 226. Selectively biasing the sampling tool 200 may enable the sampling tool 200 to continue operating and collecting downhole samples if one of the first probe 202 or second probe 226 fails by biasing the sampling tool 200 to the first probe 202 or second probe 226 that has not failed. For example, if the first screen 204 on the first probe 202 becomes clogged the sampling tool 200 may be able to bias the tool to extend the second probe 226 first, thus allowing the sampling tool 200 to continue collecting samples through the second port 234.

The stationary element 236 may include a second scraper 238. The second scraper 238 may include a blade 602 extending radially from the second scraper 238. The blade 602 may be configured to scrape a surface of the second screen 232 as the second screen 232 moves relative to the second scraper 238. For example, the second scraper 238 and associated blade 602 may be coupled to the stationary element 236, such that the second scraper 238 and the blade 602 remain substantially stationary relative to the sampling tool 200. The second screen 232 may move axially relative to the stationary element 236 and the second scraper 238 as the second probe 226 moves along the expansion axis 312. Thus, as the second screen 232 moves relative to the stationary element 236 and the second scraper 238, the blade 602 may be in sliding contact with a surface of the second screen 232, such that any debris, rocks, or mud attached to the second screen 232 may be removed by the blade 602 each time the second probe 226 moves relative to the stationary element 236.

In some embodiments, the blade 602 may be a substantially continuous element, such as an annular ring. In some embodiments, the blade 602 may be formed multiple closely spaced elements, such as fingers, or bristles. In some embodiments, the blade 602 may be formed from a rigid material, such that the material may not deform as the second screen 232 moves along the blade 602. In some embodiments, the blade 602 may be formed from a resilient material, such as a polymer material, a rubber material, a metallic material, etc.

Figure 7:
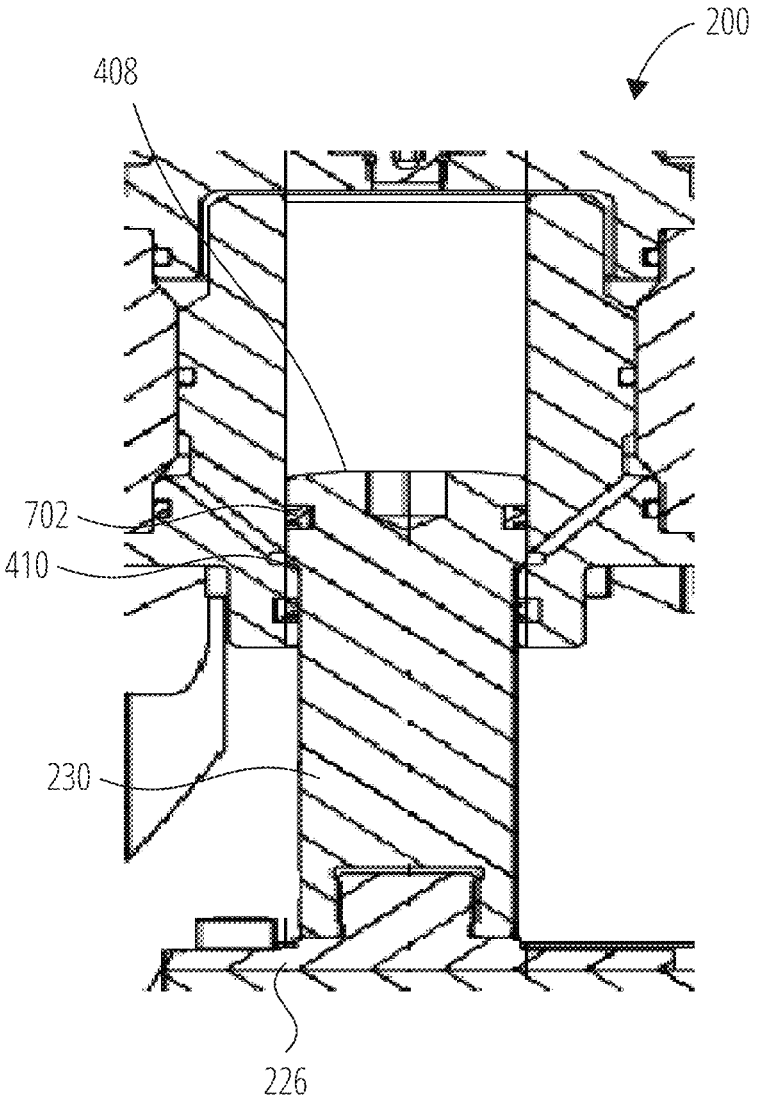
FIG. 7 illustrates an enlarged view of a portion of the embodiment of the sampling tool illustrated in FIG. 5.

FIG. 7 illustrates an enlarged view of a second piston 230 of the second probe 226 of the sampling tool 200. As illustrated in FIG. 5, the second pistons 230 may be formed from multiple second piston 230 arranged on the ends of the second probe 226. For example, the second pistons 230 may be formed from two second pistons 230, four second pistons 230, etc. In some embodiments, the second piston 230 may be a single centrally located piston similar to the first piston 208 associated with the first probe 202 illustrated in FIG. 3. For example, the second piston 230 may be arranged in a coaxial arrangement with the first piston 208 such that the second piston 230 is smaller and positioned within the first piston 208 when each of the pistons 208, 230 are retracted. In some embodiments, the second piston 230 may be arranged in a coaxial arrangement with the first piston 208 such that the first piston 208 is smaller and positioned within the second piston 230 when each of the pistons 208, 230 are retracted.

The second piston 230 may include an extending pressure surface 410 and a retracting pressure surface 408. The extending pressure surface 410 and the retracting pressure surface 408 may be separated by a seal 702. A pressurized system 400 may selectively transfer pressure to the extending pressure surface 410 and/or the retracting pressure surface 408 through the pressurized fluid 402. The pressurized fluid 402 may act on the extending pressure surface 410 of the second piston 230 to generate a force in a direction away from the sampling tool 200. The pressurized fluid 402 may act on the retracting pressure surface 408 to generate a force in a direction toward the sampling tool 200. Thus, by selectively transferring pressure to the extending pressure surface 410 through the pressurized fluid 402 the pressurized system 400 may cause the second piston 230 and the associated second probe 226 to extend away from the sampling tool 200. In another instance, the pressurized system 400 may selectively transfer pressure to the retracting pressure surface 408 through the pressurized fluid causing the second piston 230 and the associated second probe 226 to retract into the sampling tool 200.

As described above, the force exhibited on the second piston 230 may be proportional to the area of the extending pressure surface 410 and/or the retracting pressure surface 408 on which the pressurized fluid 402 is acting. The area of the extending pressure surface 410 may be greater than the area of the retracting pressure surface 408. The greater area of the extending pressure surface 410 may enable the same amount of pressure in the pressurized fluid 402 to extend the second probe 226 with more force than the pressurized fluid 402 generates to retract the second probe 226. In some instances, the pressurized system may selectively transfer pressure to both of the extending pressure surface 410 and the retracting pressure surface 408 through the pressurized fluid. Because the area of the extending pressure surface 410 is greater than the area of the retracting pressure surface 408 the net force on the second piston 230 may be in a direction away from the sampling tool 200. However, the force toward the sampling tool 200 resulting from the pressurized fluid acting on the retracting pressure surface 408 may detract from the outward force resulting from the pressurized fluid acting on the extending pressure surface 410 resulting in a reduced net outward force.

Figure 8A:
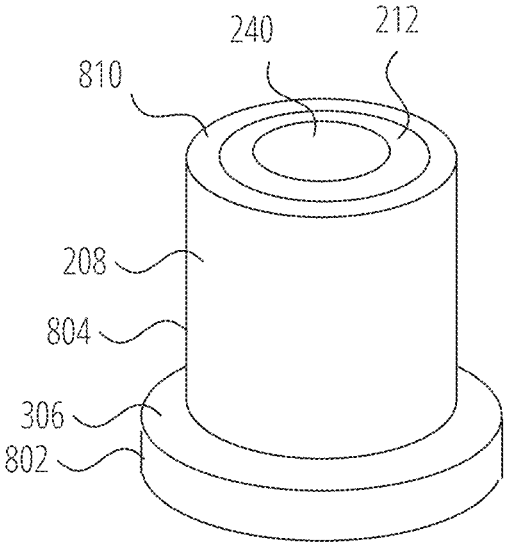
FIGS. 8A and 8B illustrate isometric views of a first piston according to an embodiment of the present disclosure.
Figure 8B:
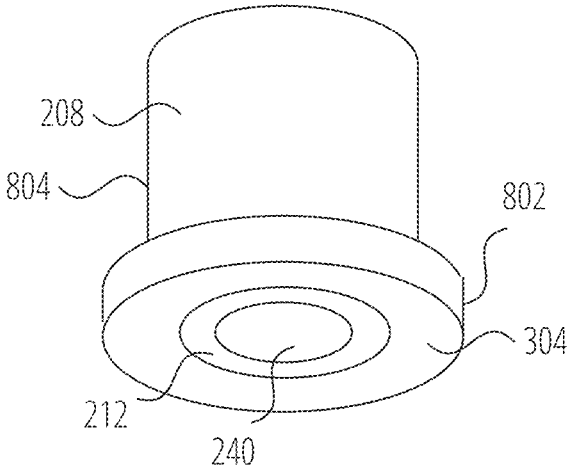

FIGS. 8A and 8B illustrate views of an embodiment of the first piston 208. In some embodiments, the first piston 208 may be substantially cylindrical in shape. The first piston 208 may be configured to surround the stationary element 212. The common internal passage 240 may pass through the stationary element 212. The extending pressure surface 304 of the first piston 208 may be defined by the area of the first piston 208 between the stationary element 212 and an outer base edge 802. The retracting pressure surface 306 may be defined by an area of the base of the first piston 208 between the outer body edge 804 and the outer base edge 802. As described above, the force exerted on the first piston 208 by the pressurized fluid 402 of the pressurized system 400 may be proportional to the area of the first piston 208 being acted upon by the pressurized fluid 402.

The area of the extending pressure surface 304 may be greater than the area of the retracting pressure surface 306. For example, the body 810 of the first piston 208 may be between the outer body edge 804 and the stationary element 212 such that the area defined between the outer body edge 804 and the outer base edge 802 is less than the area defined between the stationary element 212 and the outer base edge 802 by at least the area defined by a cross section of the body 810 of the first piston 208.

The first piston 208 may have an area ratio defined by the area of the retracting pressure surface 306 over the area of the extending pressure surface 304. As described above, in some cases, the pressurized system 400 may be configured to allow the pressurized fluid 402 to act on the extending pressure surface 304 and the retracting pressure surface 306 at the same time. When the pressurized fluid 402 acts on the extending pressure surface 304 and the retracting pressure surface 306 at the same time the net outward force may be proportional to the area ratio, where the area ratio is defined by an area of the retracting pressure surface 306 divided by an area of the extending pressure surface 304. For example, as the area ratio approaches zero the net outward force may be substantially the same as the outward force resulting when the pressurized system 400 only allows the pressurized fluid 402 to act on the extending pressure surface 304. As the area ratio approaches one the net outward force may be substantially zero as the area of the extending pressure surface 304 and the area of the retracting pressure surface 306 would be substantially the same.

Figure 8C:
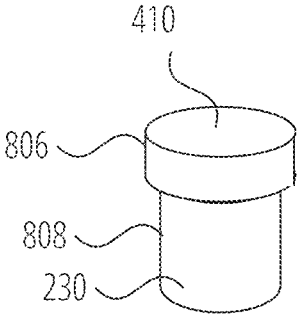
FIGS. 8C and 8D illustrate isometric views of a second piston according to an embodiment of the present disclosure.
Figure 8D:
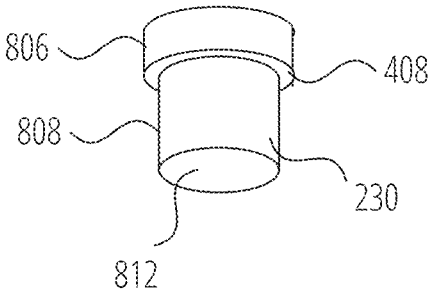

FIGS. 8C and 8D illustrate views of an embodiment of one of the second pistons 230. The extending pressure surface 410 of the second piston 230 may be defined by an area of the base of the second piston 230 defined by the outer base edge 806. Similar to the first piston 208, the retracting pressure surface 408 may defined by an area of the base of the second piston 230 between the outer body edge 808 and the outer base edge 806.

The area of the extending pressure surface 410 may be greater than the area of the retracting pressure surface 408. For example, the body 812 of the second piston 230 may occupy at least a portion of the base of the second piston 230 such that the area defined between the outer body edge 808 and the outer base edge 806 is less than the area defined between the outer base edge 806 by at least the area defined by a cross section of the body 812 of the second piston 230.

The second piston 230 may have an area ratio defined by the area of the retracting pressure surface 408 over the area of the extending pressure surface 410. As described above, in some cases, the pressurized system 400 may be configured to allow the pressurized fluid 402 to act on the extending pressure surface 410 and the retracting pressure surface 408 at the same time. As described above, with respect to the first piston 208, when the pressurized fluid 402 acts on the extending pressure surface 410 and the retracting pressure surface 408 at the same time, the net outward force may be proportional to the area ratio.

FIG. 9 illustrates an embodiment of a schematic of the pressurized system 400 with the active lines shown for the sampling tool 200 to be in the position shown in FIG. 5, with the force balanced toward the second probe 226.

The extending valve 404 and the retracting valve 406 may be configured to control flow of the pressurized fluid 402 to the pistons 208, 230. For example, as shown in FIG. 9, the extending valve 404 may selectively pressurize an extraction circuit 902 allowing flow of the pressurized fluid 402 to the extending pressure surface 304 of the first piston 208 and an extending pressure surface 410 of the second pistons 230. Further, as illustrated in FIG. 9, the retracting valve 406 may simultaneously pressurize a retraction circuit 904 allowing flow of the pressurized fluid 402 to the retracting pressure surface 306 of the first piston 208 and a retracting pressure surface 408 of the second piston 230.

As described above, the area of the extending pressure surface 304 of the first piston 208 may be greater than the combined area of the extending pressure surfaces 410 of the second pistons 230. Thus, the pressurized fluid 402 flowing to the extending pressure surface 304 of the first piston 208 and the extending pressure surfaces 410 of the second piston 230 may generate a greater amount of force against the first piston 208 than the combined force against the second pistons 230. However, the area ratio of the first piston 208 may also be greater than the area ratio of the second pistons 230. Thus, when the pressurized fluid 402 flows through both the extending valve 404 and the retracting valve 406, the net outward force on the second pistons 230 may be greater than the net outward force on the first piston 208. The greater force may cause the second pistons 230 to extend pushing the second probe 226 coupled to the second pistons 230 away from the sampling tool 200, such that the second port 234 may open allowing the sample fluid to flow into the second port 234. The lower force acting on the first piston 208 may cause the first probe 202 to only extend if the second probe 226 stops traveling before reaching the borehole wall 210, thereby ensuring that the second piston 230 is fully extended before the first probe 202 extends.

Thus, the sampling tool 200 may be selectively biased between the first probe 202 and the second probe 226 through the pressurized system 400. For example, the sampling tool 200 may be biased toward the first probe 202 by opening only the extending valve 404 and pressurizing the extraction circuit 902 such that the force on the first piston 208 is greater. The sampling tool 200 may alternately be biased toward the second probe 226 by opening both the extending valve 404 and the retracting valve 406 pressurizing both the extraction circuit 902 and the retraction circuit 904, such that the net force on the second pistons 230 is greater.

Embodiments of the present disclosure may enable an operator to selectively bias an expandable tool, such as a sampling tool. Selectively biasing an expandable tool, may enable an operator to bias the expandable tool away from a failed part, such as a broken seal or clogged port. Biasing an expandable tool away from a failed part may enable the expandable tool to continue to be used after a failure, extending the life of the tool and reducing the potential number of trips of the downhole tool to obtain desired information.

Embodiments of the present disclosure may allow a sampling tool to collect samples from more than one extendable port. Collecting samples from more than one extendable port may enable the sampling tool to continue to collect samples if one of the sampling ports fails. Embodiments of the present disclosure may further extend the life of sampling tools by reducing clogged sampling ports by filtering the sampling fluids and cleaning the filters.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. An extendable downhole tool comprising:

a first extendable probe and a second extendable probe;

a pressure system configured to apply a force to the first extendable probe and the second extendable probe, the pressure system comprising:

a first piston coupled to the first extendable probe;

a second piston coupled to the second extendable probe;

an extension valve configured to pass fluid pressure to an inner surface of the first piston and the second piston; and a retracting valve configured to pass the fluid pressure to an outer surface of the first piston and the second piston; and wherein an area ratio of the first piston defined by an area of the outer surface of the first piston over an area of the inner surface of the first piston is greater than an area ratio of the second piston defined by an area of the outer surface of the second piston over an area of the inner surface of the second piston.

2. The extendable downhole tool of claim 1, wherein the area of the inner surface of the first piston is greater than the area of the inner surface of the second piston.

3. The extendable downhole tool of claim 1, wherein the pressure system is configured to selectively bias the extendable downhole tool between the first extendable probe and the second extendable probe.

4. The extendable downhole tool of claim 3, wherein the pressure system is configured to bias the extendable downhole tool toward the first extendable probe by passing fluid pressure to the inner surface of the first piston and the second piston through the extension valve while simultaneously preventing fluid pressure from passing to the outer surface of the first piston and the second piston through the retracting valve.

5. The extendable downhole tool of claim 3, wherein the pressure system is configured to bias the extendable downhole tool toward the second extendable probe by passing fluid pressure to the inner surface of the first piston and the second piston through the extension valve while simultaneously passing fluid pressure to the outer surface of the first piston and the second piston through the retracting valve.

6. The extendable downhole tool of claim 1, wherein at least one of the first extendable probe and the second extendable probe comprises a sampling port configured to receive a fluid.

7. The extendable downhole tool of claim 6, further comprising a screen associated with the sampling port and configured to filter the fluid.

8. The extendable downhole tool of claim 7, further comprising a scraper configured to clean the screen.

9. The extendable downhole tool of claim 6, wherein the sampling port is configured to fully open when the at least one of the first extendable probe and the second extendable probe is extended.

10. The extendable downhole tool of claim 1, wherein each of the first extendable probe and the second extendable probe comprise a sampling port configured to receive a fluid.

11. A downhole sampling tool comprising:

at least two extendable probes extending in opposing radial directions from the downhole sampling tool, each of the at least two extendable probes comprising a port and a screen, the screen positioned within the port and configured to filter a fluid before the fluid enters the port;

wherein the at least two extendable probes are configured to extend from and retract over a stationary portion of the downhole sampling tool; and a scraping element coupled to the stationary portion of the downhole sampling tool, the scraping element configured to scrape a surface of the screen when the at least two extendable probes retract into the stationary portion of the downhole sampling tool.

12. The downhole sampling tool of claim 11, wherein the scraping element comprises an annular blade extending from the stationary portion of the downhole sampling tool to the surface of the screen.

13. The downhole sampling tool of claim 11, wherein the scraping element comprises multiple closely spaced elements extending from the stationary portion of the downhole sampling tool to the surface of the screen.

14. The downhole sampling tool of claim 11, further comprising a pressure system configured to extend the at least two extendable probes with a fluid pressure.

15. The downhole sampling tool of claim 14, wherein:

a first probe of the at least two extendable probes comprises a first piston, wherein the first piston comprises a first extending surface and a first retracting surface configured to receive the fluid pressure from the pressure system, wherein an area of the first retracting surface is less than an area of the first extending surface; and a second probe of the at least two extendable probes comprises a second piston, wherein the second piston comprises a second extending surface and a second retracting surface configured to receive the fluid pressure from the pressure system, wherein an area of the second retracting surface is less than an area of the second extending surface.

16. The downhole sampling tool of claim 15, wherein the area of the first extending surface is greater than the area of the second extending surface.

17. The downhole sampling tool of claim 15, wherein a first area ratio of the area of the first retracting surface over the area of the first extending surface is greater than a second area ratio of the area of the second retracting surface over the area of the second extending surface.

18. A method of biasing an extendable downhole tool comprising at least two extendable probes, the method comprising:

biasing the extendable downhole tool toward a first extendable probe of the at least two extendable probes by:

applying a pressure to an inside surface of at least two pistons coupled to the at least two extendable probes, wherein an area of the inside surface of a first piston of the at least two pistons is greater than an area of the inside surface of a second piston of the at least two pistons, and wherein the first piston is coupled to the first extendable probe and the second piston is coupled to a second extendable probe; and biasing the extendable downhole tool toward the second extendable probe of the at least two extendable probes by:

applying the pressure to both the inside surface of the at least two pistons and an outer surface of the at least two pistons, wherein an area ratio of the first piston defined by an area of the outer surface of the first piston over an area of the inside surface of the first piston is greater than an area ratio of the second piston defined by an area of the outer surface of the second piston over an area of the inside surface of the second piston.

19. The method of claim 18, wherein biasing the extendable downhole tool toward the first extendable probe comprises applying a greater force to the first extendable probe than the second extendable probe.

20. The method of claim 18, wherein biasing the extendable downhole tool toward the second extendable probe comprises applying a greater force to the second extendable probe than the first extendable probe.

* * * * *